US009565878B2

(12) United States Patent
Hernandez

(10) Patent No.: US 9,565,878 B2
(45) Date of Patent: Feb. 14, 2017

(54) CANTILEVERED BREAST SUPPORT

(71) Applicant: Gladys Hernandez, Homestead, FL (US)

(72) Inventor: Gladys Hernandez, Homestead, FL (US)

( * ) Notice: Subject to any disclaimer, the term of this patent is extended or adjusted under 35 U.S.C. 154(b) by 0 days.

(21) Appl. No.: 14/624,310

(22) Filed: Feb. 17, 2015

(65) Prior Publication Data

US 2016/0037831 A1 Feb. 11, 2016

Related U.S. Application Data

(60) Provisional application No. 61/939,995, filed on Feb. 14, 2014.

(51) Int. Cl.
*A41C 3/06* (2006.01)

(52) U.S. Cl.
CPC ..... *A41C 3/065* (2013.01)

(58) Field of Classification Search
CPC ..... A41C 3/00; A41C 3/10; A41C 3/065; A41C 3/0078; A41C 3/0028; A41C 3/124; A41C 3/0007
USPC ..... 450/41–45, 81
See application file for complete search history.

(56) References Cited

U.S. PATENT DOCUMENTS 2,041,066 A 5/1935 Howard
2,079,426 A * 5/1937 Schottenfels ..... A41C 3/0078 2/311
2,429,680 A * 10/1947 Goddard ..... A41C 3/0007 450/39
2,505,720 A * 4/1950 Cooper-Smith ..... A41C 3/124 128/889
2,608,689 A * 9/1952 Leuven, Jr. ..... A41C 3/124 450/45
2,844,151 A * 7/1958 Lemons ..... A41C 3/10 450/48
2,869,553 A * 1/1959 Nicl ..... A41C 3/065 450/81
3,276,449 A * 10/1966 Morgan ..... A41C 3/065 450/81
3,280,818 A * 10/1966 Pankey ..... A41C 3/065 450/81
3,527,231 A 1/1968 Catanese et al.
3,934,593 A * 1/1976 Mellinger ..... A41C 3/065 428/355 R
3,952,752 A 4/1976 Huttle, Jr.
(Continued)

*Primary Examiner* — Gloria Hale
(74) *Attorney, Agent, or Firm* — Walter O. Alomar-Jiménez, Esq.; DBPR Legal LLC

(57) ABSTRACT

A breast support system having a support connected to a breast lift member for maintaining a user's breasts in a suspended position. The support preferably includes a leg that is substantially linear or that includes a slight bend therein, wherein the leg can contact the user's torso and rest flush thereagainst. The breast lift member supports the underside of a breast of the user and includes a crescent shape in order to conform to the natural contours of a woman's breast in order to support and lift the same. The support is flexible so as to allow the user to move about as desired without having the device become dislodged or removed. The support can frictionally secured to the user or may include an adhesive thereon. Further, the breast lift member can be disposed at an angle relative to the support in order to comfortably support the wearer's breast.

8 Claims, 2 Drawing Sheets

(56) References Cited

U.S. PATENT DOCUMENTS

| | | | | |
|---|---|---|---|---|
| 4,343,313 | A * | 8/1982 | Le Jeune | A41C 3/065<br>450/39 |
| 5,716,255 | A | 2/1998 | Abercrombie et al. | |
| 6,666,747 | B1 * | 12/2003 | Buntz | A41C 3/065<br>424/400 |
| 2010/0210178 | A1 * | 8/2010 | Chang | A41C 3/0028<br>450/54 |

* cited by examiner

CANTILEVERED BREAST SUPPORT

CROSS REFERENCE TO RELATED APPLICATION

This application claims the benefit of U.S. Provisional Application No. 61/939,995 filed on Feb. 14, 2014. The above identified patent application is herein incorporated by reference in its entirety to provide continuity of disclosure.

BACKGROUND OF THE INVENTION

Field of the Invention

The present invention relates to breast support apparatuses. More specifically the invention relates to a breast support apparatus that can be utilized to suspend breasts without the use of a brassiere. The invention can be especially useful for women with larger breasts to effectively maintain the breasts in a suspended position as needed.

Brassieres are commonly worn in order to support the wearer's breasts. Brassieres often include straps that wrap around the torso and that further include shoulder straps. The torso and shoulder straps can be uncomfortable, particularly when the bra is secured snugly onto the user. Further, the straps may show through a user's clothing, which can be undesirable. Brassieres often do not fully support the breasts and allow the breasts to hang downward and contact the user's abdomen, which can be uncomfortable for the wearer. This can be particularly problematic for people that are overweight or that have large breasts. Thus, a device for supporting the breasts that does not include straps and that can be comfortably positioned on the user is desired.

Description of the Prior Art

Devices have been disclosed in the prior art that relate to breast support apparatuses. These include devices that have been patented and published in patent application publications. These devices generally relate to breast support apparatuses. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 2,041,066 to Howard provides a breast support apparatus having a canoe-shape comprising a solid piece of sponge rubber covered in a layer of soft cloth such as velvet, wherein the apparatus is adapted to be inserted into the pocket of a brassiere having pockets. The device is adapted to be positioned beneath each breast in order to support the same. The present invention however, provides a breast support system that can be utilized to support each individual breast having a support and a breast lift member, wherein the support can rest against the abdomen of the user and the breast lift member can be placed beneath the breast of the user to maintain the breast in a suspended position.

U.S. Pat. No. 2,429,680 to Goddard provides for a breast pallet that engages the breast on the underside thereof in order to separate the breasts and to prevent a squeezed appearance from developing. The device provides a breast supporting section and a chest engaging section, wherein the breast supporting section can be placed below the tip of the breast of the user. This device, however, does not provide a breast support system having a breast lift member and a support adapted to be positioned on the user's torso.

U.S. Pat. No. 2,505,720 to Peiser provides for a bosom shield or guard to be worn against the body and directly against the bosom in order to prevent irritation caused by the bosom contacting the body. The device includes straps, hooks and the like for application to the body of the user and can provide pockets in which cotton pads can be placed to absorb perspiration. The present invention however, does not require the use of straps or hooks to be affixed to the user and can remain securely against the user's abdomen as such, thus eliminating unsightly visible lines that often protrude through one's shirt.

U.S. Pat. No. 3,527,231 to Frank provides a bust support that comprises a breast support band having a breast support pad and a chest band. The device includes a chest band portion and breast support pads. The present invention provides a breast support device that can be fixed beneath the breast of the user in order to lift the breast and separate it from the abdomen of the user in order to eliminate the compression of the breast against the abdomen of the user.

These prior art devices have several known drawbacks. The above discussed devices do not utilize two separate breast lifting members that can be placed beneath each breast of the user having a flexible and curved support that can rest against the abdomen of the user and maintain each breast in a suspended position. In light of the devices disclosed in the prior art, it is submitted that the present invention substantially diverges in design elements from the prior art and consequently it is clear that there is a need in the art for an improvement to existing breast support devices. In this regard the instant invention substantially fulfills these needs.

SUMMARY OF THE INVENTION

In view of the foregoing disadvantages inherent in the known types of breast support apparatuses now present in the prior art, the present invention provides a new breast support apparatus wherein the same can be utilized for providing convenience for the user when wearing various garments.

It is therefore an object of the present invention to provide a new and improved breast support device that has all of the advantages of the prior art and none of the disadvantages.

It is another object of the present invention to provide a breast support device having a support that is adapted to rest against the abdomen of the user.

Another object of the present invention is to provide a breast support device having a crescent shaped breast lift member for supporting the breast of a user.

Another object of the present invention is to provide a breast support device that does not require the user of a brassiere.

Another object of the present invention is to provide a breast support device that does not require the use of straps for securement to the body of the wearer.

Yet another object of the present invention is to provide a breast support device that comprises a support leg that is flexible and is adapted to rest flush against the torso of a user.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
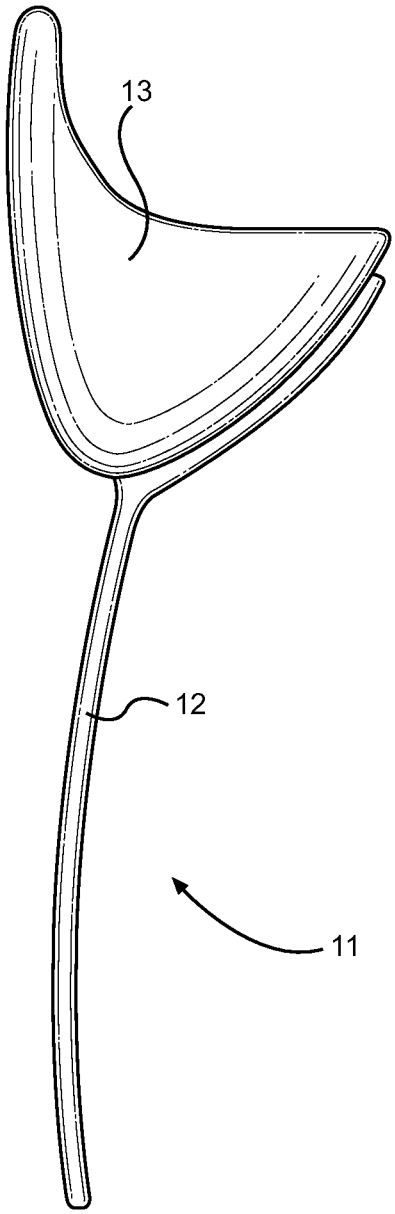
FIG. 1 shows a side view of the breast support apparatus having a support leg and a breast lift member.

Reference is made herein to the attached drawings. Like reference numerals are used throughout the drawings to depict like or similar elements of the breast support apparatus. For the purposes of presenting a brief and clear description of the present invention, the preferred embodiment will be discussed as used for maintaining a user's breast in a suspended position. The figures are intended for representative purposes only and should not be considered to be limiting in any respect.

Referring now to FIG. 1, there is shown a side view of the breast support apparatus 11 having a support 12 and at least one breast lift member 13. In the illustrated embodiment, the support 12 comprises an elongated, flexible leg having an upper end and a lower end. The support 12 is substantially linear and includes a slight bend or curve that enables the breast support apparatus 11 to conform to the contours and/or curvatures of the body of the user. The support 12 is flexible so as to move as the user moves throughout the day. The support 12 of the breast support apparatus 11 can be pliable and yielding relative to the movements of the user when walking, bending over, running, dancing, sitting and conducting normal everyday activities. The support 12 frictionally engages the user's body so as to remain in position, or may include an adhesive thereon for providing additional securement to the user's body.

Each breast lift member 13 is adapted to support the underside of a user's breast. The breast lift member 13 preferably comprises a crescent shaped structure adapted to fit the natural contours of a woman's breast. The breast lift member 13 comprises a concave edge adapted to receive and support the underside of a user's breast. Preferably, the breast lift member 13 is disposed at an angle relative to the support 12 so as to support the user's breasts in an elevated position above and away from the user's abdomen. More preferably, the breast lift member 13 is disposed at approximately a fifty degree angle relative to the longitudinal axis of the support 12. In this way, the user's breast is suspended above the user's abdomen so that the user's breast does not hang downward or rest against the user's abdomen.

In one embodiment, the breast support apparatus 11 can provide a pair of support apparatuses as described above, wherein each support apparatus 11 comprises a support 12 and a breast lift member 13. The user can place the concave edge of the breast lift member 13 beneath a breast, wherein the support leg 12 rests against the torso of the user. Thereafter, the user can place a second breast support apparatus 11 in the same manner as described above on another breast. Thus, the user can apply one breast support apparatus 11 to each breast for support thereof and proceed to put on a garment such as a shirt to one's body. The breast support member 13 will not be readily conspicuous beneath one's clothes and can be worn throughout the day while performing various tasks.

Figure 2:
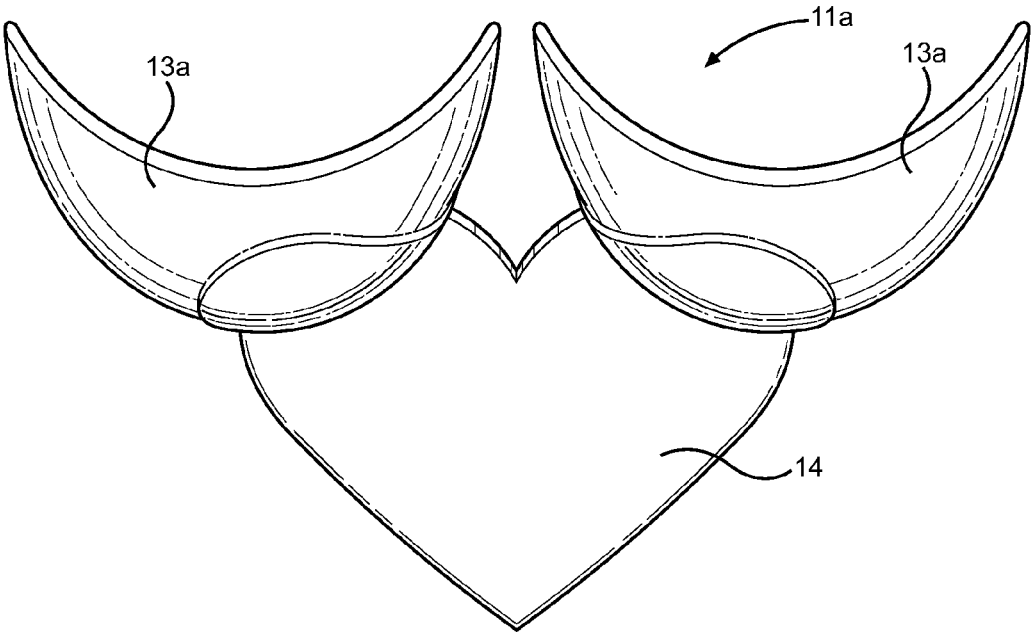
FIG. 2 shows a front view of an alternative embodiment of the breast support apparatus.

Referring now to FIG. 2, there is shown a front view of an alternative embodiment of the breast support apparatus 11*a* having a support 14 that connects a pair of breast lift members 13*a*. Preferably, the support 14 is a heart shaped structure, however, in alternate embodiments the support 14 can include other shapes or configurations. The support 14 comprises a first surface and a second surface. The second surface of the support 14 rests against the torso of the user when applied thereto. The support 14 can further extend partially onto the exterior of the breast lift members 13*a* for added support to the breast to which it is applied.

Each breast lift member 13*a* can be placed beneath the breast of the user so as to support the underside thereof. The breast lift member 13*a* contacts the user's torso in an area beneath the user's breast, and the crescent shaped structure thereof cradles the user's breast. The crescent shaped structure provides a concave edge adapted to comfortable support the underside of the user's breast so as to fit the natural contours thereof.

Figure 3:
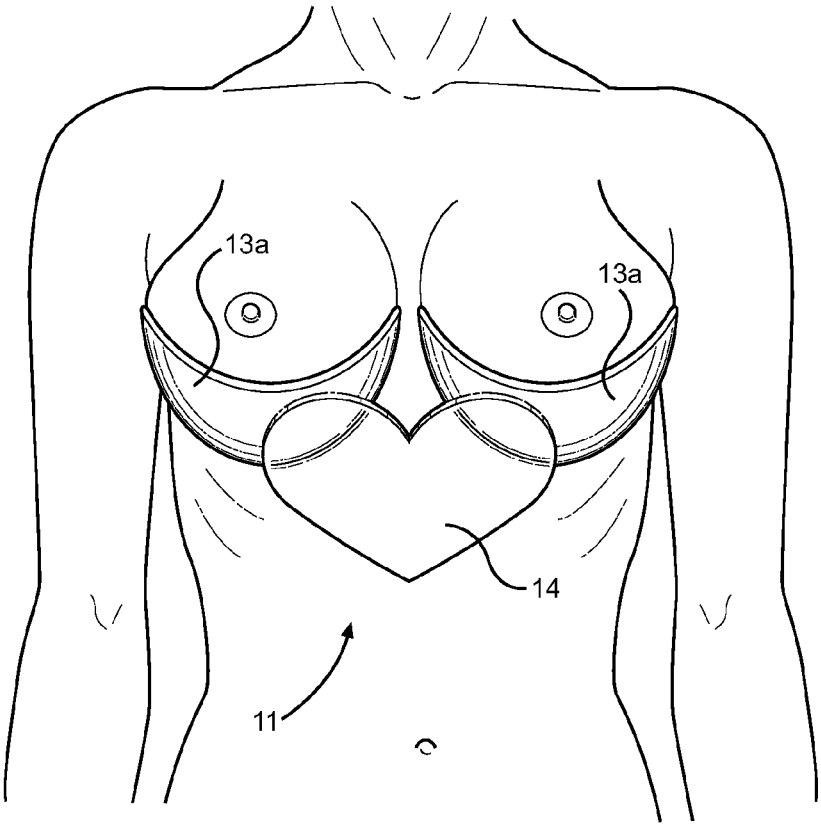
FIG. 3 shows a front view of an alternative embodiment of the breast support apparatus having a pair of breast lift members connected to one another.

Referring now to FIG. 3, there is shown a front view of an alternative embodiment of the breast support apparatus 11*a* having a pair of breast lift members 13*a* connected to one another in use with the breast and torso of the user. The breast support apparatus 11*a* comprises a pair of breast lift members 13*a* disposed in an adjacent relationship to one another and connected to one another via a support 14 that is heart-shape and is disposed therebetween. Once applied to the body of the user, the pointed lower end of the heart shaped structure rests against the abdomen of the user. The second side of the heart shaped structure provides an adhesive in a preferred embodiment that is covered by a film that can be peeled back by the user in order to reveal the adhesive thereunder. Thus, the support 14 can be adhesively secured to a user's torso in a desired position. The heart shaped structure 14 is disposed at an angle, thereby providing slight flexibility and is able to hold and support the weight of the user's breasts.

The pointed lower end of the support 14 rests against the user's torso when applied thereto and is flexible so as to allow the user to perform daily activities such as walking, driving, bending over, and the like. The breast lift member 13*a* can also include an adhesive in order to readily attach and adhere to one's skin when applied thereto. There can be a protective film that lays against the adhesive on the second side of the breast lift member 13*a* that can be peeled back by the user in order to reveal the adhesive thereunder. As such, the user can place the breast support apparatus 11*a* against the body for application where it will remain until manually removed via the user.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A breast support apparatus:

a support member having a flexible leg, wherein said flexible leg comprises an elongated structure, said elongated structure comprises an angled upper end and a vertically curved lower end, wherein said support member is adapted to be positioned on a user's torso;

at least one breast lift member, wherein said elongated structure is adapted to be arranged vertically when said at least one breast lift member is used to support a breast; and wherein said at least one breast lift member is connected to said angled upper end of said support member, said breast lift member adapted to support an underside of a breast.

2. The breast support apparatus of claim 1, wherein said at least one breast lift member comprises a crescent shaped structure, said crescent shaped structure having a concave portion adapted to fit below a breast to maintain the breast in a suspended position.

3. The breast support apparatus of claim 1, said leg being flexible such that said leg is adapted to flex while a user is in motion.

4. The breast support structure of claim 1, wherein said at least one breast lift member is disposed at an angle relative to said support.

5. The breast support structure of claim 4, wherein said at least one breast lift member is disposed at approximately a fifty degree angle relative to a longitudinal axis of said support.

6. The breast support structure of claim 1, said support member comprises a heart-shaped structure having a pointed lower end adapted to rest against the torso of a user.

7. The breast support structure of claim 1, wherein said support member comprises an adhesive thereon for securement to a user's torso.

8. The breast support structure of claim 1, wherein said at least one breast lift member comprises an adhesive thereon for securement to a user.

* * * * *